United States Patent [19]

Seino et al.

[11] Patent Number: 4,984,435

[45] Date of Patent: Jan. 15, 1991

[54] BRINE REFRIGERATING APPARATUS

[75] Inventors: Toshio Seino, Tokyo; Norio Tatsumi, Takasaki, both of Japan

[73] Assignee: Dairei Co. Ltd., Tokyo, Japan

[21] Appl. No.: 376,589

[22] Filed: Jul. 7, 1989

[51] Int. Cl.[5] ..... F25D 17/02

[52] U.S. Cl. ..... 62/434; 62/185

[58] Field of Search ..... 62/59, 185, 442, 441, 62/434, 520, 79

[56] References Cited

U.S. PATENT DOCUMENTS

| | | | |
|---|---|---|---|
| 2,075,225 | 3/1937 | Post, Jr. | 62/434 X |
| 2,473,508 | 6/1949 | Collins . | |
| 2,512,545 | 6/1950 | Hazard . | |
| 2,975,609 | 3/1961 | Allander et al. | 62/442 X |
| 3,144,079 | 8/1964 | Mack | 62/520 X |
| 3,247,678 | 4/1966 | Mohlman | 62/185 X |
| 3,257,818 | 6/1966 | Papapana | 62/185 X |
| 3,766,752 | 10/1973 | Laing | 62/434 X |
| 4,024,728 | 5/1977 | Gustafsson | 62/79 |
| 4,302,944 | 12/1981 | Gainer | 62/59 |

FOREIGN PATENT DOCUMENTS

| | | |
|---|---|---|
| 588566 | 11/1933 | Fed. Rep. of Germany . |
| 1933788 | 1/1971 | Fed. Rep. of Germany . |
| 1601874 | 2/1971 | Fed. Rep. of Germany . |
| 2546812 | 4/1976 | Fed. Rep. of Germany . |
| 2359579 | 2/1978 | France . |
| 124608 | 12/1926 | Switzerland . |
| 136739 | 2/1930 | Switzerland . |
| 1410255 | 10/1975 | United Kingdom . |
| 1417406 | 12/1975 | United Kingdom . |

*Primary Examiner*—Lloyd L. King

*Attorney, Agent, or Firm*—Sandler, Greenblum & Bernstein

[57] ABSTRACT

A brine refrigerating apparatus includes a cooling chamber which is divided into a plurality of cooling sections by shelves provided in the cooling chamber, each shelf having a brine pipe in which a cold brine flows.

14 Claims, 5 Drawing Sheets

BRINE REFRIGERATING APPARATUS

BACKGROUND OF THE INVENTION

1. Field of the Invention

The present invention relates to a brine refrigerating apparatus in which brine is used as a coolant.

2. Description of Related Art

It is preferable to keep foodstuffs, such as perishables or raw noodles in cold storage at a constant temperature and high humidity. It is difficult to realize such an isothermal atmosphere of high humidity using a refrigeration cycle in which cooling is effected by a phase change of the coolant. Because of this difficulty, a brine refrigerator has been used, in which brine having a high latent heat is used as a coolant.

In a conventional brine refrigerator, cooled brine is circulated along wall surfaces of a refrigerating chamber. There are two known types of cooling systems, one of which has four cooling surfaces of right and left side surfaces, an upper surface and back surface, and the other having five cooling surfaces of right and left side surfaces, an upper surface, back surface and bottom surface. In the brine refrigerators, a difference in temperature between the cooling surfaces and the cooling chamber can be decreased to increase the dew point temperature of the cooling surfaces, thereby resulting in high humidity.

In the known brine refrigerators, it is possible to restrict the fluctuation of temperatures in the refrigerator within 1° C. due to convection of the cold air at no load in which no foodstuff is put in the refrigerator. It has been found, however, that when foodstuffs fill the cooling chamber, it is impossible to realize an ideal storage condition due to a temperature difference of the foodstuffs. This is because when the cooling chamber is filled with the foodstuffs, no effective convection of the cold air takes place, so that the foodstuffs are cooled only by the heat transmission between the foodstuffs and the wall surfaces of the cooling chamber. To solve this problem, it is necessary to provide a large dead space in the cooling chamber in order to decrease the temperature difference in the cooling chamber, thus resulting in a decreased cooling efficiency.

Perishables have different inherent optimum storage temperatures depending on the kind thereof. However, in the conventional refrigerator in which a low temperature chamber is located at an upper portion of the refrigerator and a vegetable storing chamber of a relatively high temperature is located at a lower portion of the refrigerator, there is no distribution of different storing temperatures, which depend upon the particular foodstuffs being refrigerated. For example, in a conventional three-door refrigerator or four-door refrigerator, there is a distribution of temperatures of "below −10° C.", "approximately 0° C.", "approximately 5° C.", and "approximately 10° C.". Namely, it is impossible to provide a temperature distribution of a pitch of 1°~2° C. between −1° C. and 10° C.

SUMMARY OF THE INVENTION

The primary object of the present invention is therefore to provide a brine refrigerator in which a substantially uniform distribution of temperatures can be achieved even when it is filled with foodstuffs or other materials.

Another object of the present invention is to provide a brine refrigerator which has finely divided ranges of temperatures.

The inventors of the present invention have reviewed conventional brine refrigerators in which the brine passages must be provided on the wall surfaces of the cooling chamber and have found that such a conventional structure itself is a cause of non uniform distribution of temperature in the cooling chamber.

Namely, one of the significant features of the present invention resides in a plurality of shelves, each having a brine pipe in which a cold brine flows, provided in the cooling chamber.

With this arrangement, small spaces which are defined between and by adjacent shelves are cooled by the associated adjacent shelves, resulting in a substantially uniform distribution of temperatures in the cooling chamber.

Note that the term "shelf" or "shelves" used in the specification of the present invention can include an upper surface and a bottom surface of the cooling chamber.

Preferably, the shelves are made of a material having a thermal conductivity, such as metal.

It is preferable to provide a cold brine feeding device which includes a circulation pump on the lower portion of the cooling chamber in order to improve the stability (balance of weight) of the refrigerator.

It is advisable to produce a flow of brine from a brine pipe of a lower shelf toward a brine pipe of an upper shelf in order to achieve an effective cooling. In this arrangement, it is preferable to provide a relief valve which prevents the flow of brine from the shelf side toward the circulation pump side and a closing valve which closes when the circulation pump stops in a connecting feed pipe extending from the circulation pump to the uppermost brine pipe and in a connecting discharge pipe extending from the lowermost brine pipe to the circulation pump, respectively, so that the circulation pump has no load when the refrigerator starts to work.

Preferably, an auxiliary reservoir is provided in the brine passage and is connected thereto through a restriction. The auxiliary reservoir absorbs a possible change in volume of brine due to a change of temperature to prevent the brine pipes from being broken or damaged due to change of pressure.

Preferably, there is also provided means for differentiating the temperatures of the cooling sections.

The differentiating means can be embodied by the brine pipes which are connected to a feed line and a discharge line (recovering line), of the cold brine, so that the flow rate of the brine flowing from the feed line to the brine pipes of the shelves can be controlled by control valves. Namely, the temperatures of the cooling sections (chambers) defined by and between the adjacent shelves can be optionally and precisely controlled by the control of the quantity of the brine to be fed to the brine pipes of the shelves.

It is also possible to realize different temperatures of the cooling sections by the fact that cold air moves down and that the temperature of the brine gradually increases due to the heat exchange during circulation thereof.

Namely, a brine feed device is provided in which the brine pipes of the shelves are successively connected to each other to form a continuous brine passage, so that the brine flows from the lower brine pipes to the upper brine pipes. In the brine feed device, the temperature of the brine in the brine pipe of a lower shelf is lower than that of the brine in the brine pipe of an upper shelf, so that the temperatures of the upper cooling sections are higher than those of the lower cooling sections. The difference pitch of temperatures which is for example 1°~2° C. can be controlled by controlling the temperature or the flow rate of brine.

BRIEF DESCRIPTION OF THE DRAWINGS

The invention will be described below in detail with reference to the accompanying drawings, in which.

DESCRIPTION OF PREFERRED EMBODIMENTS

Figure 3:
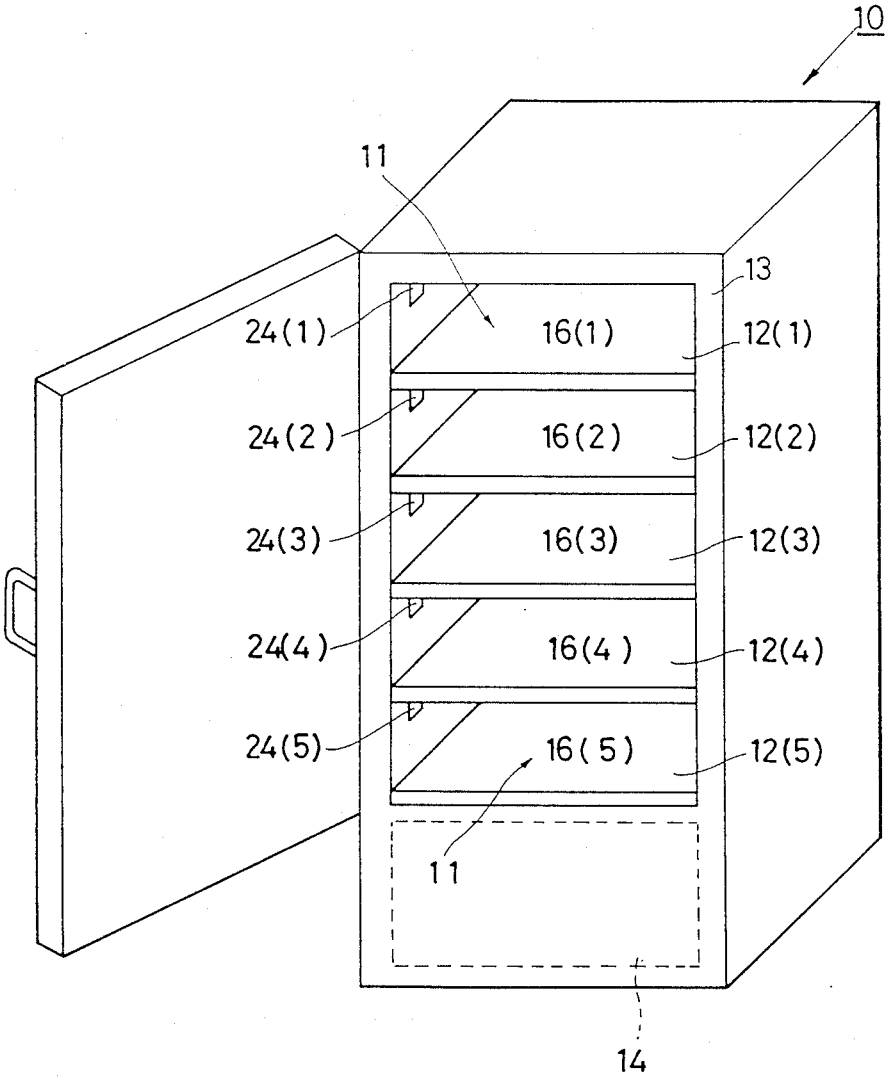

The brine refrigerating apparatus according to the present invention is generally shown at 10 in FIG. 3, in which a cooling chamber 11 is divided into a plurality of cooling sections (chambers) 16 by shelves 12 which are made of a thermally conductive material, such as aluminum alloy. The peripheral wall 13 of the cooling chamber 11 is made of a thermally insulated material. In the illustrated embodiment, five shelves 12(1), 12(2), 12(3), 12(4) and 12(5) are provided. The number of the shelves is not limited to five and can be more or less than five. The refrigerator has a machine chamber 14 located below the cooling chamber 11 to accommodate a cold brine feeding device.

Each shelf 12 has a brine pipe 15 integrally connected thereto, which is continuously snaked to increase a contact surface with the shelf. The brine pipes 15 can be made of separate pieces which are secured to the undersides of the associated shelves 12. Alternatively, it is also possible to provide shelves 12, each made of two laminated metal layers between which the associated brine pipes are formed. The shelves 12 can have air holes (not shown) through which a cold air passes.

The adjacent upper and lower brine pipes 15 are connected to each other by connecting pipes **15*b*, so that a continuous brine passage is formed. The brine pipe 15 of the lowermost shelf 12(5) is connected to a brine heat exchanger 22 through a feed line 17 which has therein a relief valve (one-way valve) 19. The brine pipe 15 of the uppermost shelf 12(1) is connected to a circulation pump 20 through a discharge line 18 which has therein an electromagnetic control valve 21**.

Figure 1A:
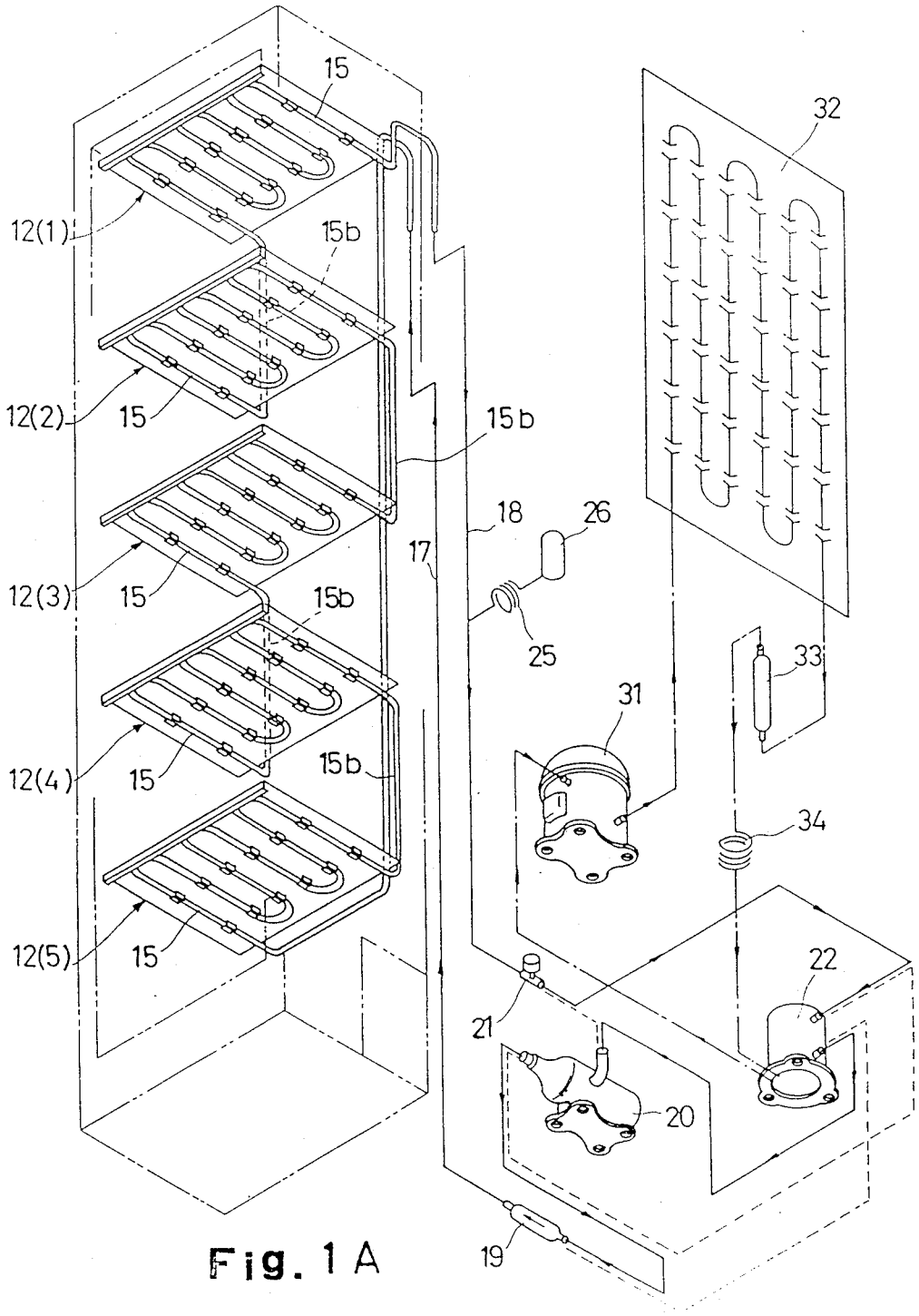
FIG. 1A is an exploded schematic perspective view of a main part of a brine refrigerating apparatus according to an aspect of the present invention.
Figure 1B:
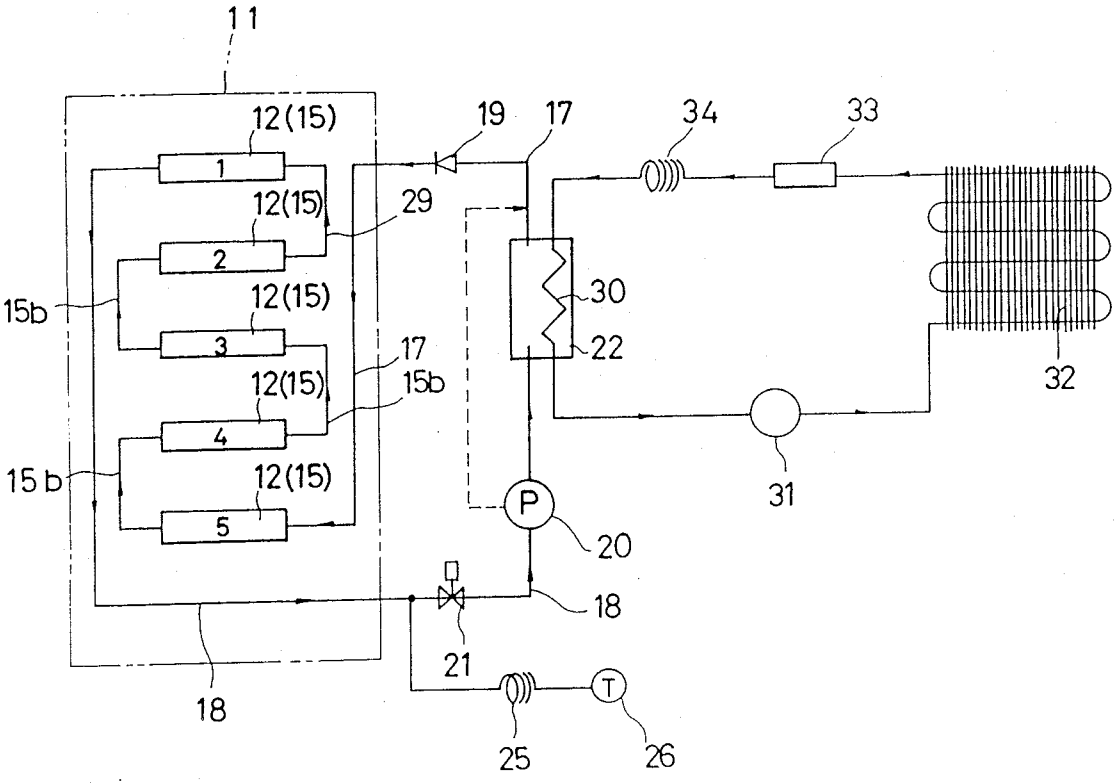
FIG. 1B is a diagram of a connection showing the flow of a coolant used in the apparatus shown in FIG. 1.

The relief valve 19 allows the brine to flow only in one direction from the circulation pump 20 to the shelves 12. The electromagnetic control valve 21 is associated with the circulation pump 20 so that the valve opens when the circulation pump 20 operates and is closed when the circulation pump 20 does not operate. The feed line 17 extends upward to the level of the uppermost shelf 12(1) and is bent downward to be connected to the brine pipe 15 of the lowermost shelf 12(5), as shown in FIG. 1A. The discharge line 18 is connected to an auxiliary tank (accumulator) 26 through a capillary tube (restriction) 25.

The brine heat exchanger 22 is cooled by a refrigeration cycle per se known. Namely, the brine heat exchanger 22 has therein an evaporator 30 using a coolant gas, so that the evaporator 30 constitutes a refrigeration cycle together with a compressor 30, a condenser 32, a dryer 33 and a capillary tube 34 which are connected in this order as viewed in the direction of flow. The brine in the brine heat exchanger 22 is cooled to a predetermined temperature by the refrigerating operation of the refrigeration cycle, so that the cooled brine is recirculated in the brine passage by the circulation pump 20.

The components of the refrigeration cycle except for the condenser 32, and the cold brine feeding device which is formed by the brine heat exchanger 22 and the circulation pump 20 are located in the machine chamber 14 below the cooling chamber 11.

When the circulation pump 20 and the compressor 31 operate, the brine cooled in the brine heat exchanger 22 flows in the brine pipes 15 of the shelves 12. Namely, the brine cooled to a predetermined temperature first enters the brine pipe 15 of the lowermost shelf 12(5) and successively flows up while cooling the circumference. The brine which is discharged from the brine pipe 15 of the uppermost shelf 12(1) is returned by the circulation pump 20 through the discharge line 18, to the brine heat exchanger 22 where it is cooled again. Thus, the circulation is repeated.

The shelves 12 are provided to divide the cooling chamber into several sections (cooling spaces) 16(1)~16(5) located one on another, and accordingly the foodstuffs stored in the cooling spaces defined between two adjacent shelves 12 can be effectively cooled. There is substantially no difference in temperature between the cooling spaces. It is advisable to use containers which are substantially snugly inserted in the cooling spaces between the shelves and which receive therein the foodstuffs. The use of such containers prevents an increase of the temperature in the cooling chamber when the foodstuffs are put in and taken out from the refrigerator. The cold air tends to escape from the cooling chamber 11 particularly when the foodstuffs are put in and taken out from the refrigerator. The containers also contribute to an increased storage efficiency. Preferably, the containers are labelled, for example "BEEF", "PORK", "CHICKEN", "SHELL", "FISH", or "VEGETABLE" etc. having different storage temperatures.

The temperature in the cooling chamber 11 can be controlled by the set temperature in the brine heat exchanger 22, the quantity of brine in the circulation pump 20, and the selective operation of the circulation pump 20.

The temperature of brine gradually ascends due to heat exchange during circulation and the cold air moves down. This makes it possible to produce different cooling temperatures in the cooling sections without using a special opening and closing valve or a flow rate control valve. Namely, in the illustrated embodiments, supposing that the entrance temperature of brine at the entrance of the brine pipe 15 of the lowermost shelf 12(5) is −2° C.~−3° C., the temperatures of the cooling sections 16(5)~16(1) will be gradually ascending. For example the temperatures of the cooling sections 16(5)~16(1) can be −2° C.~0° C., 0° C.~2° C., 2° C.~4° C., 4° C.~6° C. and 6° C.~8° C., respectively. The temperature distribution can be optionally selected.

If such a fine distribution of temperatures is unnecessary, it is possible to reverse the direction of flow of brine, so that the brine discharged from the brine heat exchanger 22 is introduced to the brine pipe 15 of the uppermost shelf 12(1).

In the illustrated embodiment, the electromagnetic opening and closing valve 21 is closed when the circulation pump 20 does not operate. Accordingly, the brine in the brine pipes of the shelves 12 cannot be returned to the brine heat exchanger 22 or the circulation pump 20. Also, since the feed line 17 extends up to the height of the uppermost shelf 12(1), as mentioned before, the return of the brine to the brine heat exchanger 22 or the circulation pump 20 can be prevented.

In a conventional brine refrigerator, the cold brine feeding device is usually located above the cooling chamber to prevent the brine from being completely discharged from the associated brine pipes, resulting in a decreased stability due to an unbalanced weight. On the contrary, in the present invention, the brine always exists in the associated brine pipes without being completely discharged therefrom, as mentioned above. Furthermore, since the body weight (the cold brine feeding device etc.) is located below the cooling chamber 11 at the bottom of the refrigerator, the stability of the brine refrigerator can be enhanced, in the present invention.

In particular, if a change in volume of brine takes place when the circulation pump 20 is stopped, the brine moves between the discharge line 18 and the auxiliary tank 26 to absorb the volume change in order to prevent the refrigerator from being broken or damaged due to an increased pressure. The capillary tube 25 allows the brine to flow therethrough only when a pressure difference between the discharge line 18 and the auxiliary tank 26 exceeds a predetermined value.

Although the circulation pump 20 is connected to the outlet side of the brine heat exchanger 22, in the embodiment shown in FIG. 1A, it is theoretically possible to connect the circulation pump 20 to the inlet side of the brine heat exchanger, as shown by the imaginary lines. However, it is not advisable for the circulation pump 20 to give a kinematic energy to the cold brine cooled to a predetermined temperature by the brine heat exchanger 22, resulting in a decreased precision of temperature control. Therefore, it is preferable to provide the circulation pump 20 on the inlet side of the brine heat exchanger 22 that has a higher brine temperature, past the cooling chamber.

Figure 2A:
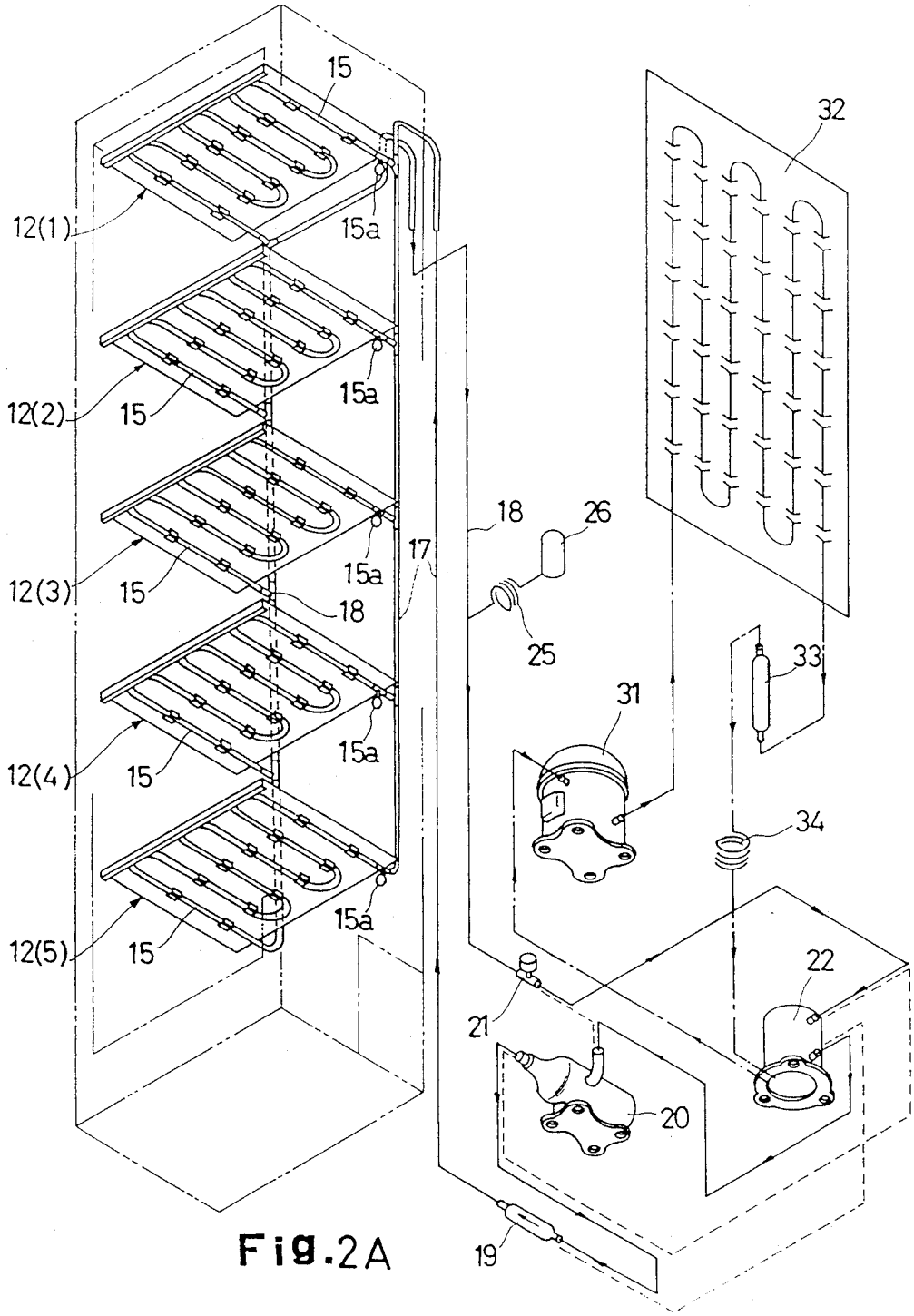
FIGS. 2A and 2B are views similar to FIGS. 1A and 1B, but according to another aspect of the present invention; and, FIG. 3 is a perspective view of a brine refrigerator according to the present invention.
Figure 2B:
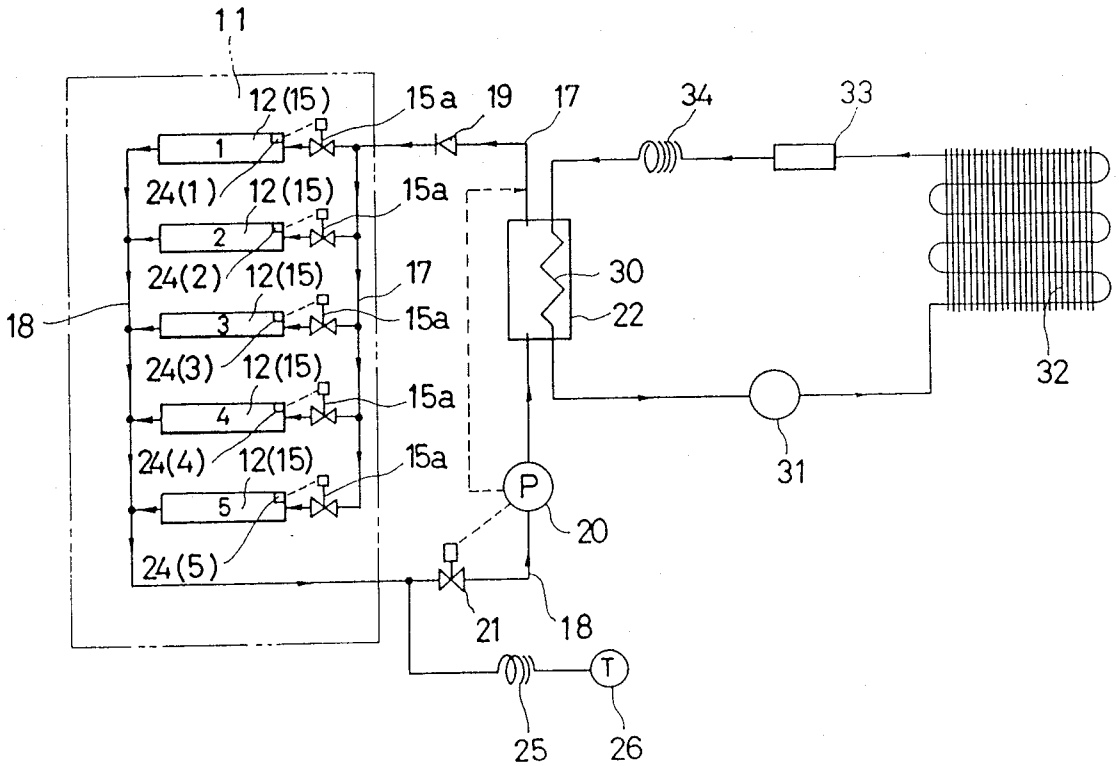

FIGS. 2A and 2B show another embodiment of the present invention, in which the cooling sections 16(1)~16(5) have different temperatures. In the second embodiment shown in FIGS. 2A and 2B, the feed line 17 and the discharge line 18 which are located on the side of the shelves 12(1)~12(5) are connected to the circulation pump 20 through the relief valve 19 and to brine heat exchanger 22 through the electromagnetic opening and closing valve 21, respectively.

The feed line 17 and the discharge line 18 are connected to the brine pipes 15 of the shelves 12. Namely, the brine pipes 15 of the shelves 12 are connected to each other in parallel between the feed line 17 and the discharge line 18. The control valves (or the flow rate control valves) **15*a* are provided between the feed line 17 and the respective brine pipes 15. The operation of the control valves 15*a* is controlled by temperature sensors 24(1)~24(5) provided in the respective cooling sections 16(1)~16(5)**.

The feed line 17 and the discharge line 18 extend up to the height of the uppermost shelf 12(1) to prevent the brine from flowing down during stoppage of the circulation pump 20.

In the brine refrigerator as constructed above, when the circulation pump 20 and the compressor 31 are driven, the cold brine cooled by the brine heat exchanger 22 is fed to the feed line 17. Since the feed line 17 is connected to the brine pipes 15 of the shelves 12 through the control valves **15*a*, cold brine is fed into the brine pipes 15 having the open control valves 15*a* and is not fed to the brine pipes 15 having the closed control valves 15*a*. As a result, it is possible to precisely control the temperature of the cooling sections 16(1)~16(5) by the control of the control valves 15*a*. The brine discharged to the discharge line 18 through the brine pipes 15 enters the brine heat exchanger 22 through the circulation pump 20 and is cooled again in the brine heat exchanger 22**. Thus, the circulation is repeated.

The temperatures of the cooling sections (chambers) 16 can be controlled by the control of the feed or the flow rate of the brine which is in turn controlled by the operation of the control valves **15*a*. For instance, the cooling sections 16 can have different temperatures at a pitch of about 2° C. Namely, supposing that the entrance temperature of brine at the entrance of the feed line 17 is −2° C.~3° C., the temperatures of the cooling sections 16(5)~16(1)** will be for example −2° C.~0° C. (set temperature is about −1° C.), 0° C.~2° C. (set temperature is about 1° C.), 2° C.~4° C. (set temperature is about 3° C.), 4° C.~6° C. (set temperature is about 5° C.) and 6° C.~8° C. (set temperature is about 7° C.), respectively.

We claim:

1. A brine refrigerating apparatus comprising a cooling chamber which is divided into a plurality of cooling sections by shelves provided in the cooling chamber, said shelves comprising at least an uppermost shelf and a lowermost shelf, each shelf having a brine pipe in which a cold brine flows so as to form a continuous brine passage between said shelves, said apparatus including a feed line which extends longitudinally to the height of said uppermost shelf and bends downward in connecting relation to a brine pipe of said lowermost shelf of said brine refrigerating apparatus, and a cold brine feeding device connected to said continuous brine passage, said cold brine feeding device having a circulating pump for feeding said cold brine to said continuous brine passage, wherein said brine feeding device is located below said cooling chamber so as to enhance the stability of said brine refrigerating apparatus.

2. A brine refrigerating apparatus according to claim 1, wherein said shelves are made of a thermally conductive material.

3. A brine refrigerating apparatus according to claim 1, wherein said feed line connects the brine passage to an outlet of the circulation pump.

4. A brine refrigerating apparatus according to claim 3, further comprising an auxiliary tank which is connected to the brine passage through a restriction.

5. A brine refrigerating apparatus according to claim 4, wherein said restriction is in the form of a capillary tube.

6. A brine refrigerating apparatus according to claim 5, further comprising a relief valve provided in the feed line which allows the brine to flow only in one direction from the circulation pump to the brine passage.

7. A brine refrigerating apparatus according to claim 6, further comprising a discharge line which connects the brine passage to an inlet of the circulation pump.

8. A brine refrigerating apparatus according to claim 7, further comprising a control valve which is provided in the discharge line and which is closed when the operation of the circulation pump is stopped.

9. A brine refrigerating apparatus according to claim 8, wherein said cold brine feeding device further comprises a brine heat exchanger which cools the brine circulated in the brine passage to form a refrigeration cycle.

10. A brine refrigerating apparatus comprising a cooling chamber which is divided into a plurality of cooling sections by shelves provided in said cooling chamber, said shelves comprising at least an uppermost shelf and a lowermost shelf, each shelf having a brine pipe in which a cold brine flows, said apparatus further including means for establishing different temperatures in said cooling sections comprising a brine feed line connected in parallel to the brine pipes of said shelves, and a brine discharge line connected in parallel to the brine pipes of said shelves of said brine refrigerating appartus.

11. The brine refrigerating apparatus of claim 10, further including a plurality of control valves for controlling the flow of brine from said brine feed line to said brine pipes of said shelves.

12. The brine refrigerating apparatus of claim 11, further comprising temperature sensors provided in said cooling sections for detecting the temperatures of said cooling sections, whereby said control valves are controlled by said temperature sensors.

13. The brine refrigerating apparatus of claim 12, wherein said shelves are located one above another, such that said cooling sections are separated from one another in the vertical direction.

14. The brine refrigerating apparatus of claim 13, wherein said means for establishing different temperatures comprises a brine feed device in which the brine pipes of said shelves are successively connected to each other, such that the cold brine flows from the pipes of the lowermost shelf to the brine pipes of the uppermost shelf of said brine refrigerating apparatus.

* * * * *

UNITED STATES PATENT AND TRADEMARK OFFICE

CERTIFICATE OF CORRECTION

PATENT NO. : 4,984,435

DATED : January 15, 1991

INVENTOR(S) : TOSHIO SEINO et al.

It is certified that error appears in the above-identified patent and that said Letters Patent is hereby corrected as shown below:

Title page, item [22], insert column entitled ---[30] Foreign Application Priority Data--- and under this column, insert ---February 16, 1989 [JP] Japan.....1-36999; April 27, 1989 [JP] Japan.....1-108128.

Signed and Sealed this

Seventeenth Day of November, 1992

*Attest:*

DOUGLAS B. COMER

*Attesting Officer*

*Acting Commissioner of Patents and Trademarks*